US009951488B2

(12) United States Patent
Arciszewski

(10) Patent No.: US 9,951,488 B2
(45) Date of Patent: Apr. 24, 2018

(54) VEHICLE BARRIER

(71) Applicant: Tomasz Arciszewski, Staunton, VA (US)

(72) Inventor: Tomasz Arciszewski, Staunton, VA (US)

( * ) Notice: Subject to any disclaimer, the term of this patent is extended or adjusted under 35 U.S.C. 154(b) by 638 days.

(21) Appl. No.: 14/499,223

(22) Filed: Sep. 28, 2014

(65) Prior Publication Data

US 2015/0023730 A1 Jan. 22, 2015

Related U.S. Application Data

(63) Continuation of application No. 13/111,700, filed on May 19, 2011, now abandoned.

(60) Provisional application No. 61/346,514, filed on May 20, 2010.

(51) Int. Cl.

| | |
|---|---|
| ***E01F 15/14*** | (2006.01) |
| ***E01F 13/12*** | (2006.01) |
| ***E02B 3/10*** | (2006.01) |
| ***E01F 13/00*** | (2006.01) |
| ***E01F 15/00*** | (2006.01) |
| ***E01F 15/08*** | (2006.01) |

(52) U.S. Cl.

CPC ..... *E01F 15/14* (2013.01); *E01F 13/00* (2013.01); *E01F 13/12* (2013.01); *E01F 15/00* (2013.01); *E01F 15/08* (2013.01); *E02B 3/108* (2013.01); *Y10T 29/49826* (2015.01)

(58) Field of Classification Search

CPC ..... E01F 13/12; E01F 13/00; E01F 13/02; E02B 3/106; E02B 3/10

USPC ..... 405/114, 52, 107, 115, 302.4, 302.6, 405/302.7; 404/6, 9

See application file for complete search history.

(56) References Cited

U.S. PATENT DOCUMENTS

| | | | | |
|---|---|---|---|---|
| 5,704,730 | A | 1/1998 | Burton-Chambers | |
| 6,413,014 | B1 | 7/2002 | Melin | |
| 7,121,764 | B2 * | 10/2006 | Rorheim | 405/107 |
| 7,258,505 | B2 | 8/2007 | Dehart | |
| 2006/0233609 | A1 | 10/2006 | Gelfand et al. | |

* cited by examiner

*Primary Examiner* — Amber R Anderson
*Assistant Examiner* — Patrick F Lambe
(74) *Attorney, Agent, or Firm* — David Grossman

(57) ABSTRACT

A shaped barrier comprises a substantially horizontal portion, a ramp portion, a substantially vertical portion, and at least one connector. The substantially horizontal portion is configured to increase the stabilizing force between the shaped barrier and the ground in an effective amount to prevent substantial movement of the shaped barrier by distributing at least a portion of a groundward force of a rolling vehicle on a receiving side of the shaped barrier. The ramp portion is configured to receive the rolling vehicle onto the horizontal portion. The substantially vertical portion is configured to impede the movement of the rolling vehicle. The at least one connector is configured to connect the shaped barrier with at least one other shaped barrier.

19 Claims, 17 Drawing Sheets

VEHICLE BARRIER

CROSS-REFERENCE TO RELATED APPLICATIONS

This application is a continuation of U.S. application Ser. No. 13/111,700, filed May 19, 2011, which claims the benefit of U.S. Provisional Application No. 61/346,514, filed May 20, 2010, which is hereby incorporated by reference in its entirety.

DESCRIPTION OF THE DRAWINGS

Example

Example

Example

Example

Example

Example

Example

Example

Example

Example

Example

Example

Example

Example

Example

Figure 15A:
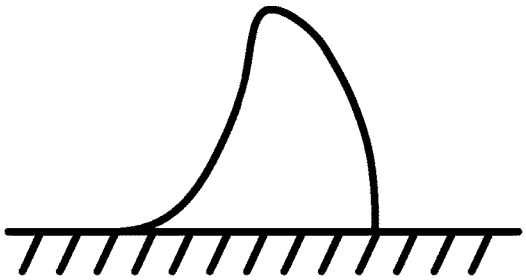

Examples FIG. 15A through FIG. 15 F illustrate several example shell shaped barriers in accordance with aspects of embodiments.

Figure 16B:
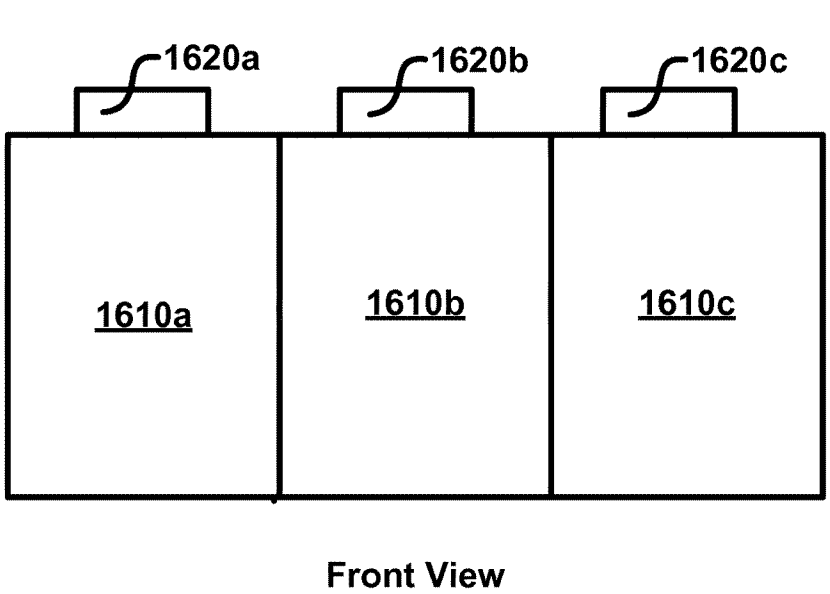
Figure 16A:
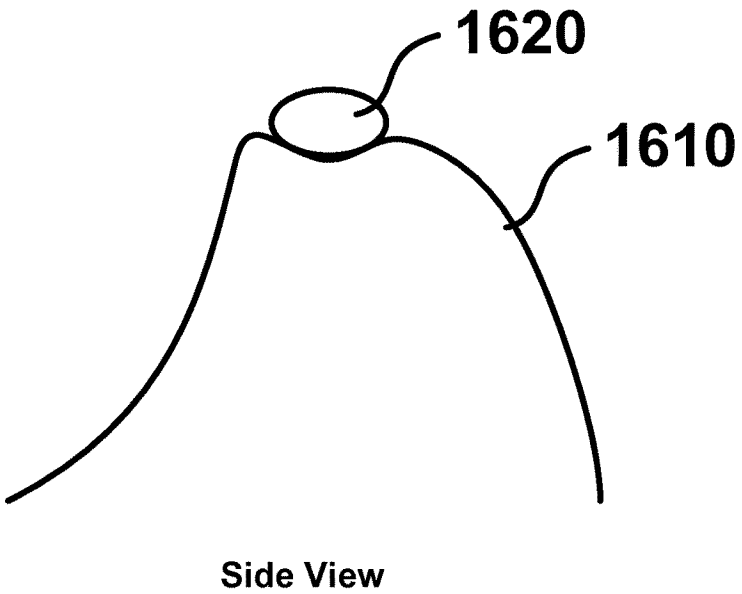

Example FIG. 16A illustrates a side view of a weighted shell shaped barrier in accordance with aspects of embodiments.

Example FIG. 16B illustrates a front view of joined and weighted shell shaped barrier in accordance with aspects of embodiments.

Figure 17A:
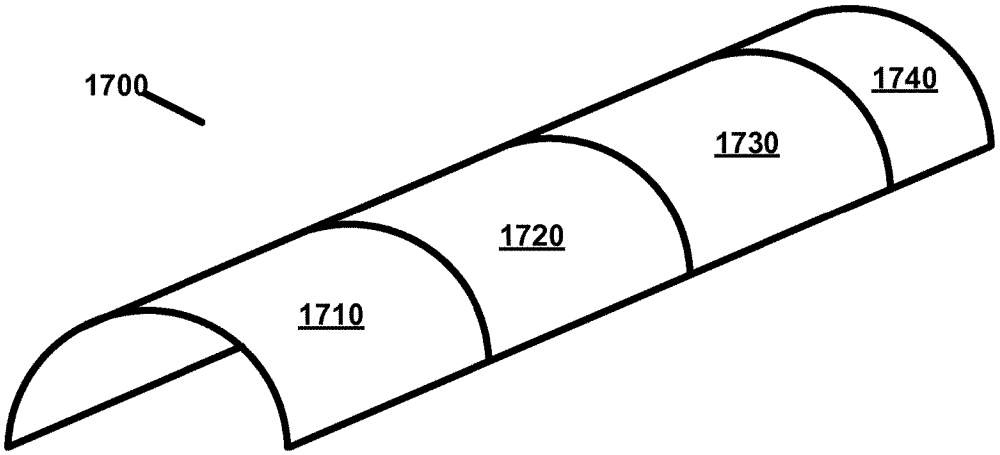
Figure 17B:
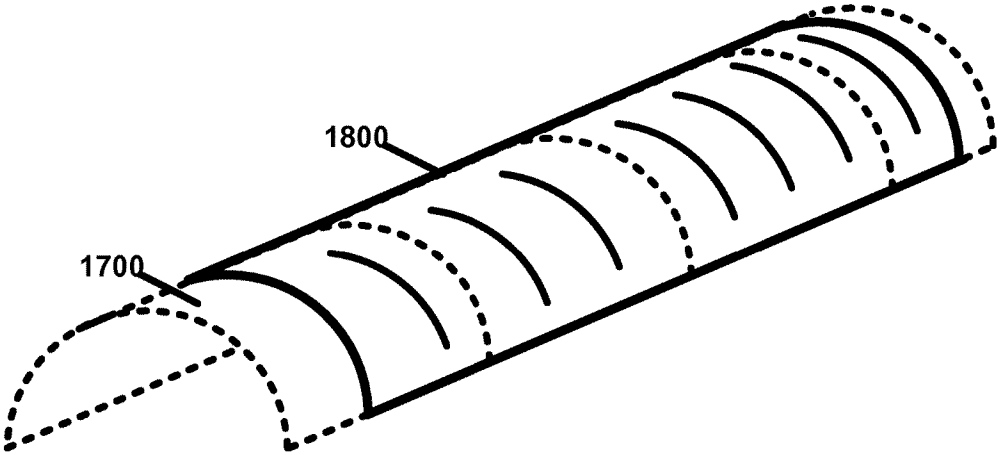

Example FIG. 17A and FIG. 17B illustrate joined shell shaped barriers in accordance with aspects of embodiments.

DESCRIPTION OF THE EMBODIMENTS

According to embodiments, a barrier may relate to any structure configured to substantially contain, impede and/or block any material, for example a resting and/or moving material. In embodiments, a barrier may be configured to contain, impede and/or block a material over any desired area, for example soil, grain, salt, cement, sand and/or fluid material over a containment area. In embodiments, a barrier may be configured to contain, impede and/or block a fluid over a flood area. In embodiments, a barrier may be configured to contain, impede and/or block a mechanical object, for example a vehicle over a roadway. In embodiments, a barrier may be configured to contain, impede and/or block a moveable material and/or a contact body over a protected area and/or safe area, for example a vehicle across highway working zones, fluid across flood areas, and the like. In embodiments, a barrier may attenuate the force resulting from an approaching moveable material.

According to embodiments, barrier properties may be tailored. In embodiments, barrier properties may be tailored to account for barrier environment and/or barrier use. In embodiments, barrier properties may be tailored irrespective of barrier environment and/or use. In embodiments, the properties of a barrier may be tailored by configuring the size, shape, assembly and/or composition of a barrier and/or barrier portion, alone or in combination.

According to embodiments, barrier size may be configured to include any selected barrier length, width, height, weight, mass, volume and/or density. In embodiments, a shaped barrier and/or shaped barrier portion may be configured to include one or more barrier cavities, for example formed by one or more barrier walls. In embodiments, a shaped barrier and/or shaped barrier portion may be configured to include one or more barrier spaces, for example formed between barrier walls.

According to embodiments, a barrier cavity and/or barrier space may be filled with a material to form a non-solid volume and/or a solid volume. In embodiments, a barrier cavity and/or a barrier space may be filled with any suitable material, which may account for selected barrier weight, mass, density, and the like. In embodiments, a material filling a barrier cavity and/or barrier space may include air, liquid, PVC, steel, fiberglass, plastic, rubber, aluminum, cement, concrete, sand, soil, plastic, rubber, urethane, polyvinyl foam, and the like. In one aspect of embodiments, a non-solid volume may be formed by filling a double shell structure with a gas, such as air, a liquid, such as water, a bulk material, such as soil, and the like. In another aspect of embodiments, a non-solid volume may be formed by including a barrier cavity and/or barrier space in a vacuous state.

According to embodiments, filling a barrier cavity and/or barrier space may form a solid volume. In embodiments, a solid volume may include the same and/or different material than the composition of a shaped barrier and/or shaped barrier portion. In one aspect of embodiments, a solid volume may be formed by filling a double shell structure with concrete, clay, and the like. In another aspect of embodiments, a thickness of a shaped barrier may form a solid volume.

According to embodiments, barrier shape and/or assembly may be configured to include a curved semicircular, curved parabolic, L, reversed T, triangular, rectangular, square and/or amorphous barrier shape, and the like. Several example amorphous barrier shapes are shown in FIG. 15A through FIG. 15F. In embodiments, barrier shape and/or assembly may be configured by any fabrication process. In one aspect of embodiments, a shaped barrier and/or shaped barrier portion may be fabricated by an etching process, for example etching from a bulk barrier composition. In embodiments, a shaped barrier and/or shaped barrier portion may be shaped in one-dimension, two-dimensions and/or three-dimensions.

According to embodiments, a shaped barrier may be formed by, for example, molding a shaped barrier portion to include any desired barrier size, barrier shape, and the like. In one aspect of embodiments, a shaped barrier portion may be molded to include an L-shape having a substantially vertical portion and a substantially horizontal portion. In another aspect of embodiments, a shaped barrier portion may be molded into a curved shaped barrier.

Figure 15D:
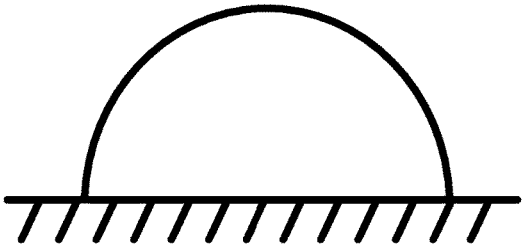
Figure 15B:
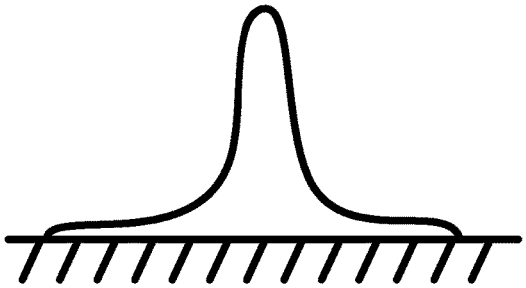
Figure 15E:
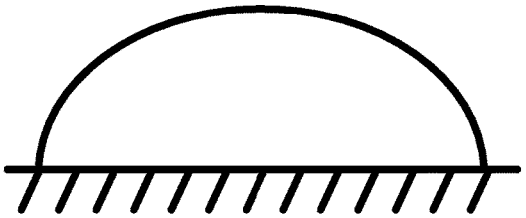
Figure 15C:
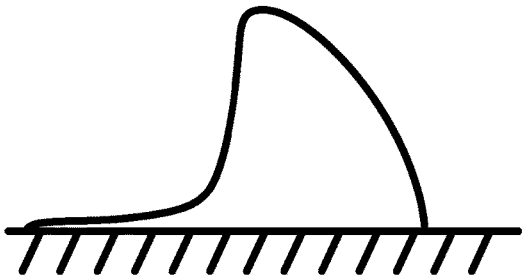
Figure 15F:
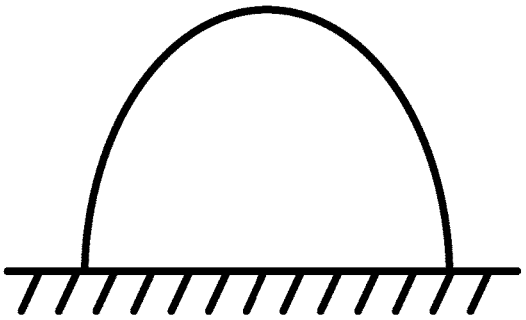

Examples of various shell shaped barriers as per aspects of the present invention are illustrated in FIG. 15A through FIG. 15F. Horizontal and vertical forces may be translated through curved portions of the shell shaped barriers. FIG. 15A illustrates a shell shaped barrier with a concave portion on one side of the barrier and a convex portion on the other side of the barrier. FIG. 15B illustrates a shell shaped barrier with an inverted T shape. FIG. 15C illustrates a shell shaped barrier with a concave and horizontal portion on one side of the barrier and a convex portion on the other side of the barrier. FIG. 15D illustrates a shell shaped barrier with a half round shape. FIG. 15E illustrates a shell shaped barrier with a horizontally elongated half round shape. FIG. 15F illustrates a shell shaped barrier with a vertically elongated half round shape. These barriers may be deployed in either direction depending on current desires. These shapes may be molded with a concave bottom forming a barrier cavity. The barrier cavity may create an inner shell shape which may conform to the outer wall shape. In alternative embodiment, the inner shell shape may be different than the outer wall shape. The shape of the shell shape barrier may be configured to enable stacking and efficient storage of the barriers. The shell shape may not be limited to a single wall. For example, a double shell structure having an outer wall and an inner wall could provide a barrier space.

According to embodiments, a shaped barrier may be formed by connecting two or more separate shaped barrier portions. In embodiments, a connection may include a mechanical, chemical and/or magnetic connection, and the like. In embodiments, a connection may include one or more rigid and/or hinge connectors. In one aspect of embodiments, a connector may include a hinge, weld, bolt, adhesive, seal, rail, magnet, fastener, clip, lock-and-key, and the like.

In one aspect of embodiments, two substantially planar barrier portions may be connected to form an L-shaped barrier, T-shaped barrier, triangular shaped barrier, and the like. In another aspect of embodiments, three substantially planar portions may be connected to form a triangular shaped barrier, T-shaped barrier, and the like. In yet another aspect of embodiments, two or more substantially curved barrier portions may be connected to form a circular shaped barrier, a parabolic shaped barrier, and the like.

According to embodiments, a shaped barrier and/or a shaped barrier portion may be configured to include one or more barrier substantially smooth surfaces. In embodiments, a shaped barrier and/or a shaped barrier portion may be configured to include one or more deformable and/or rigid portions. In embodiments, a shaped barrier and/or a shaped barrier portion may be configured to include one or more barrier walls. In embodiments, one or more barrier walls may include a deformable, rigid, rough and/or smooth portion. In embodiments, a portion of one or more barrier walls may not be uniform. In one aspect of embodiments, a surface of one or more barrier walls may include trenches, divots, and the like, in any desired geometry. In embodiments, trenches may be v-shaped grooves, u-shaped grooves, toothed grooves, wave shape, and the like. In embodiments, trenches may be tapered, spaced apart at any desired distance, and/or in any desired direction. In embodiments, the uniformity of one or more barrier walls may be formed at any time before and/or after the manufacture of a shaped barrier and/or shaped barrier portion.

According to embodiments, barrier shape and/or assembly may be configured to include a single shaped barrier. In embodiments, a shaped barrier may be configured to connect with one or more other shaped barriers. In embodiments, a shaped barrier and/or a shaped barrier portion may include one or more collapsible sections, for example using one or more connectors. In embodiments, a connectable and/or collapsible shaped barrier may enable relatively fast, efficient and/or effective barrier storage, deployment, use, and the like.

According to embodiments, barrier shape and/or assembly may be configured to include one or more support members, for example to support one or more shaped barriers and/or shaped barrier portions. In embodiments, a support member may include one or more of a block, tie, sheet, rod, truss, brace and/or spike, and the like, in any desired geometry. In one aspect of embodiments, a support member may include a square block, step shaped block, rectangle block, triangle block, z-shape brace, tie, rod, and the like. In embodiments, a support member may be formed as a portion of, and/or configured to contact and/or connect with, a shaped barrier and/or shaped barrier portion.

According to embodiments, a support member may be connected with a shaped barrier and/or shaped barrier portion at one or more points using a connector. In embodiments, a support member may be exposed to the environment. In one aspect of embodiments, a block separating two portions of a shaped barrier may support one or more of the portions and be exposed to the environment. In embodiments, a support member may be hidden from the environment. In one aspect of embodiments, a brace separating two walls of a barrier space may support the shaped barrier and be hidden from the environment.

According to embodiments, barrier shape and/or assembly may be configured to include one or more stabilization enhancers, for example to stabilize a shaped barrier and/or shaped barrier portion from substantial movement. In embodiments, a stabilization enhance may include one or more of a block, tie, sheet, rod, brace and/or spike, and the like, in any desired geometry. In embodiments, a stabilization enhancer may be formed as a portion of, and/or configured to contact and/or connect with, a shaped barrier and/or shaped barrier portion. In embodiments, a stabilization enhancer may be connected with a shaped barrier and/or shaped barrier portion at one or more points using a connector. In embodiments, a stabilization enhancer may be exposed to the environment. In one aspect of embodiments, a stabilization enhancer may be partially disposed above the ground on a safe-zone side of the shaped barrier. In embodiments, a stabilization enhancer may be hidden from the environment. In one aspect of embodiments, a stabilization enhancer may be disposed in the ground on a receiving side of a shaped barrier.

According to embodiments, barrier shape and/or assembly may be configured to include one or more energy absorbers, for example to absorb a portion of the energy of a moveable material and/or contact body. In embodiments, an energy absorber may include one or more of a block, sheet, rod, and the like, in any suitable geometry. In embodiments, an energy absorber may be manufactured as a portion of, and/or configured to contact and/or connect with, a shaped barrier and/or shaped barrier portion. In embodiments, an energy absorber may be connected with a shaped barrier and/or shaped barrier portion at one or more points using a connector. In embodiments, an energy absorber may be exposed to the environment. In one aspect of embodiments, an energy absorber may be disposed between a shaped barrier and a contact body on the receiving side of a shaped barrier. In one aspect of an embodiment, the energy absorber may be configured to absorb at a portion of a horizontal force.

According to embodiments, a wall of a barrier, a support member of a barrier, a stabilization enhancer of a barrier and/or an energy absorber of a barrier may include any material. In one aspect of embodiments, the material may include fluid, gas, PVC, steel, fiberglass, plastic, rubber, aluminum, concrete, plastic, rubber, urethane, polyvinyl foam, and the like.

According to embodiments, barrier shape and/or assembly may be configured to include one or more discontinuities between two or more shaped barriers. In embodiments, one or more discontinuities may be formed by including one or more separations between two or more shaped barriers. In one aspect of embodiments, two edge shaped barriers may be separated from each other at one end of each shaped edge barrier and may be interconnected to each other at the other end of each edge shaped barrier. In embodiments, two edge shaped barriers 1720 and 1740 may be directly interconnected with each other and/or may be indirectly interconnected with each other. In one aspect of embodiments, intermediate shaped barriers may indirectly interconnect two edge shaped barriers with each other.

Example FIG. 17A and FIG. 17B illustrate joined shell shaped barriers 1700 (shown as 1710, 1720, 1730 and 1740) in accordance with aspects of embodiments. As shown in this example, two edge shaped barriers 1720 and 1740 are interconnected through shaped barriers 1720 and 1730. In some embodiments, these barriers may be connected with a seal to prevent or otherwise minimize leakage through the barrier. Alternatively, a liner material 1800 may be placed over portions of the barriers to prevent or otherwise minimize leakage through the barrier. Liner material 1800 may be made of plastic sheeting or other material that minimizes leakage. Some liners may be made of other materials such as a woven material. Some woven materials may be coated with other materials such as polymers, rubber or the like to add strength and/or moisture resistance. Examples of liner materials include polyethylene, EPDM rubber, PVC and HDPE. Liner materials are available from several companies including BLT liners of Pineville, Oreg.

In some embodiments, the barriers may be laid out so that they do not seal. For example, it may be that the barriers need to be laid out at an angle from each other to navigated a turn. In these types of situations, the liners may be used to join the barriers to prevent or otherwise minimize leakage. According to some embodiments, the liners may be fastened to the barriers.

Alternatively, solid joining caps may be used that interconnect barriers at various angles. For example, a 30 degree joining cap may be used to fasten two barriers at 30 degrees. In yet other embodiments, some barriers may be constructed to curve. To achieve a bend in a series of barrier, one could join one or more curved barriers together.

According to embodiments, barrier composition may be configured to include any material, for example to include polymer and/or metal material. In embodiments, barrier composition may be configured to include PVC, steel, fiberglass, plastic, rubber, aluminum, concrete, plastic, rubber, urethane, and the like. In one aspect of embodiments, a shaped barrier and/or shaped barrier portion may include PVC material where a barrier contains bulk material including soil, gravel, and the like. In another aspect of embodiments, a shaped barrier and/or shaped barrier portion may include steel material where a barrier blocks a vehicle. In yet another aspect of embodiments, a shaped barrier and/or shaped barrier portion may include plastic and/or fiberglass material where a barrier impedes a fluid. In embodiments, stiffness properties of a barrier may be maximized.

According to embodiments, a shaped barrier may leverage the energy of a material to contain, impede and/or block the material. In embodiments, the energy of a material may include, but is not limited to: potential energy, strain energy, kinetic energy or the like. In embodiments, a shaped barrier may be configured to increase the stabilizing force in an effective amount between the shaped barrier and the ground to prevent substantial movement of the shaped barrier. In embodiments, barrier size, shape, assembly and/or composition may be configured to leverage the energy of a material and/or to increase the stabilizing force between a barrier and the ground.

According to embodiments, a barrier may be configured to distribute a portion of a groundward force of a material contacting the barrier, for example on a receiving side of the barrier. In embodiments, a groundward force of a material may include a portion of the energy of the material, for example a portion of the energy of the material directed towards the ground. In embodiments, a groundward force of a material may include a portion of the weight of a moveable material and/or contacting body. In embodiments, a groundward force of a material may include a portion of an approaching force of a moveable material and/or contacting body relative to a barrier. In embodiments, the movement of a shaped barrier and/or shaped barrier portion may include movement in a horizontal plane relative to the ground and/or movement in a vertical plane relative to the ground.

According to embodiments, breaking, sliding and/or overturning of a shaped barrier may be minimized. In embodiments, the weight and/or mass of a moveable material may be leveraged to maximize the properties of a shaped barrier, such that a shaped barrier may be relatively light for transport but relatively heavy when contacted. In embodiments, a shaped barrier may be configured to leverage the energy of a movable material to maximize the frictional force between the shaped barrier and the ground. In embodiments, a connectable and/or collapsible shaped barrier may enable relatively fast, efficient and/or effective barrier storage, deployment, use, and the like.

Figure 1:
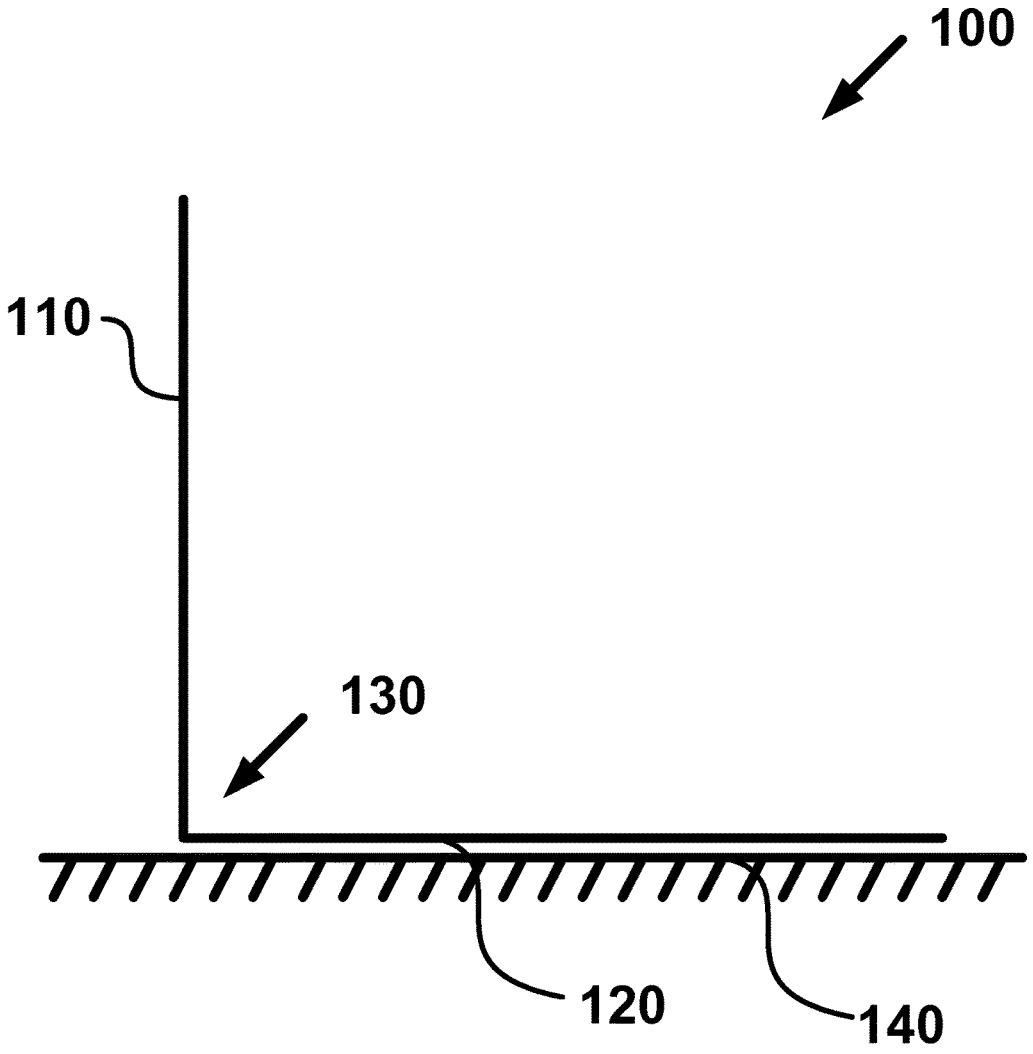
FIG. 1 illustrates an L-shaped barrier in accordance with one aspect of embodiments.

Referring to example FIG. 1, an L-shaped barrier is illustrated in accordance with one aspect of embodiments. According to embodiments, L-shaped barrier 100 may include vertical portion 110 and/or horizontal portion 120. In embodiments, vertical portion 110 may be connected with horizontal portion 120 at connection area 130. In embodiments, vertical portion 110 may be positioned from horizontal portion 120 in any desired configuration. In embodiments, vertical portion 110 may be in a raised position spaced apart from ground 140 and/or horizontal portion 120.

In embodiments, vertical portion 110 may be raised in any amount, for example raised at approximately a 45 degree angle, a 90 degree angle or the like. In embodiments, horizontal portion 120 may be in a ground position contacting ground 140. As illustrated in one aspect of embodiments, connection area 130 may be disposed midway between vertical portion 110 and horizontal portion 120, vertical portion 110 may be positioned perpendicular to horizontal portion 120, and vertical portion 110 may be spaced apart from horizontal portion 120 by approximately 90 degrees.

According to embodiments, L-shaped barrier 100 may be configured to connect with another shaped barrier. In one aspect of embodiments, L-shaped barrier 100 may include a connector configured to connect with a complimentary connector of an adjacent L-shaped barrier. In embodiments, two L-shaped barriers may be interconnected at one end of each barrier to form a relatively larger L-shaped barrier. In embodiments, a discontinuity may be formed by having a separation between the interconnected L-shaped barriers at the other end of each L-shaped barrier.

Figure 2:
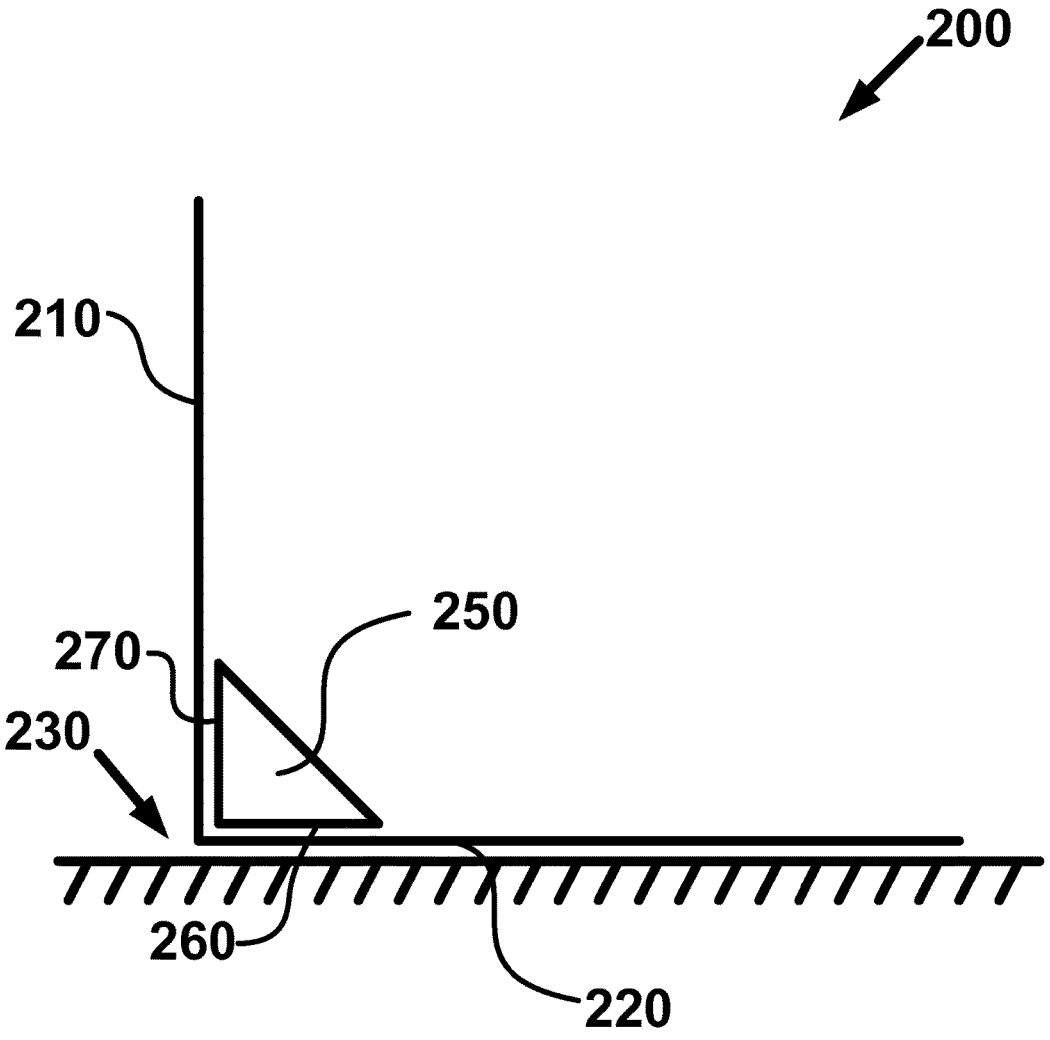
FIG. 2 illustrates an L-shaped barrier including a support member in accordance with one aspect of embodiments.

Referring to example FIG. 2, an L-shaped barrier including a support member is illustrated in accordance with one aspect of embodiments. According to embodiments, L-shaped barrier 200 may include vertical portion 210 and/or horizontal portion 220. In embodiments, vertical portion 210 may be connected with horizontal portion 220 at connection area 230. In embodiments, vertical portion 210 may be in a raised position and horizontal portion 220 may be in a ground position.

According to embodiments, L-shaped barrier 200 may include one or more support members 250. As illustrated in one aspect of embodiments, support member 250 may be a triangle block exposed to the environment and positioned to contact vertical portion 210 and/or horizontal portion 220. In embodiments, positioning support member 250 to contact L-shaped barrier 200 may minimize connection steps related to bars, ties, and the like.

According to embodiments, support member 250 may be connected to barrier 200 at one or more points using a connector. In embodiments, side 260 of support member 250 may be connected to horizontal portion 220 at one or more points along side 260. In embodiments, side 270 of support member 250 may be connected to vertical portion 210 at one or more points along side 270. In embodiments, a portion of support member 250 adjacent connection area 230 may be beveled and/or may be connected to shaped barrier 200. In embodiments, support member 250 may support vertical portion 210 and/or horizontal portion 220. In embodiments, support member 250 may minimize movement of vertical portion 210 and/or horizontal portion 220 about connection area 230.

Figure 3:
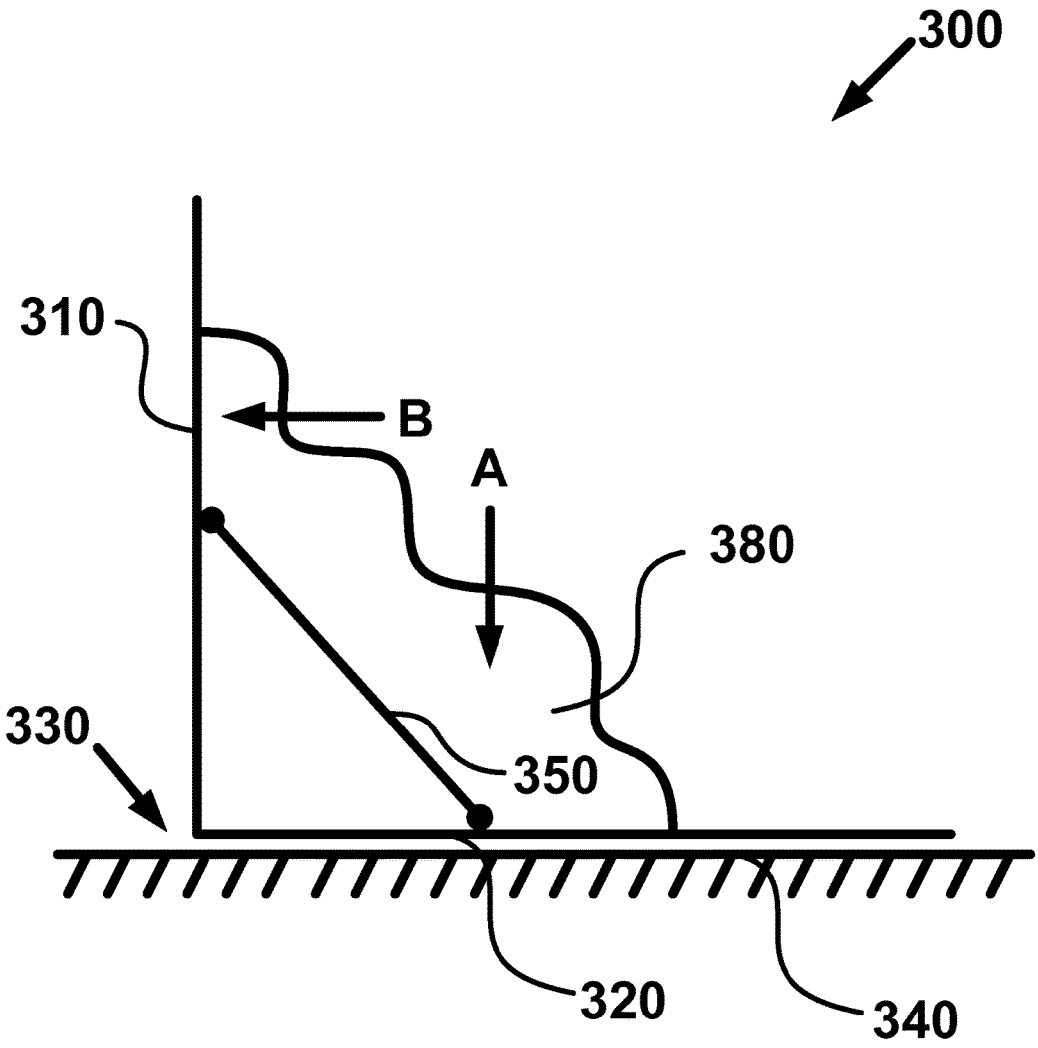
FIG. 3 illustrates an L-shaped barrier including a support member and substantially containing, impeding and/or blocking resting and/or moving bulk material in accordance with one aspect of embodiments.

Referring to example FIG. 3, an L-shaped barrier including a support member and substantially containing, impeding and/or blocking resting and/or moving bulk material is illustrated in accordance with one aspect of embodiments. According to embodiments, L-shaped barrier 300 may include vertical portion 310 and/or horizontal portion 320. In embodiments, vertical portion 310 may be connected with horizontal portion 320 at connection area 330. In embodiments, vertical portion 310 may be in a raised position and horizontal portion 320 may be in a ground position.

According to embodiments, L-shaped barrier 300 may include one or more support members 350. As illustrated in one aspect of embodiments, support member 350 may be a tie exposed to the environment and positioned to contact vertical portion 310 and/or horizontal portion 320. In embodiments, support member 350 may be connected to vertical portion 310 and/or horizontal portion 320 at one or more points using a connector.

According to embodiments, L-shaped barrier 300 may leverage the weight of a bulk material 380 to contain, impede and/or block bulk material 380. In embodiments, L-shaped barrier 300 may be configured to increase the stabilizing force in an effective amount between L-shaped barrier 300 and ground 340 to prevent substantial movement of L-shaped barrier 300. In embodiments, barrier size, shape, assembly and/or composition may be configured to leverage the weight of bulk material 380 and/or to increase the stabilizing force between L-shaped barrier 300 and ground 340.

As illustrated in one aspect of embodiments, L-shaped barrier 300 may be configured to distribute a portion of groundward force A of bulk material 380 contacting shaped barrier 300, for example on the receiving side of L-shaped barrier 300. In embodiments, groundward force A of bulk material 380 may include a portion of the weight and/or mass of moveable material 380. In embodiments, groundward force A of moveable material 380 may include a portion of an approaching force of moveable material 380 relative to L-shaped barrier 300. In embodiments, substantial movement of L-shaped barrier 300 may be prevented in a horizontal plane relative to ground 340 and/or in a vertical plane relative to ground 340.

According to embodiments, force A of bulk material 380 applied to horizontal portion 320 may keep L-shaped barrier 300 from substantially moving across ground 340. In embodiments, horizontal portion 320 may distribute force A of bulk material 380 in an effective amount to prevent substantial movement of L-shaped barrier 300. As illustrated in one aspect of embodiments, force B of bulk material 380 may be countered by horizontal portion 320 and/or support member 350. In embodiments, L-shaped barrier 300 may keep bulk material 380 from substantially spreading to undesired and/or predetermined areas.

Figure 4:
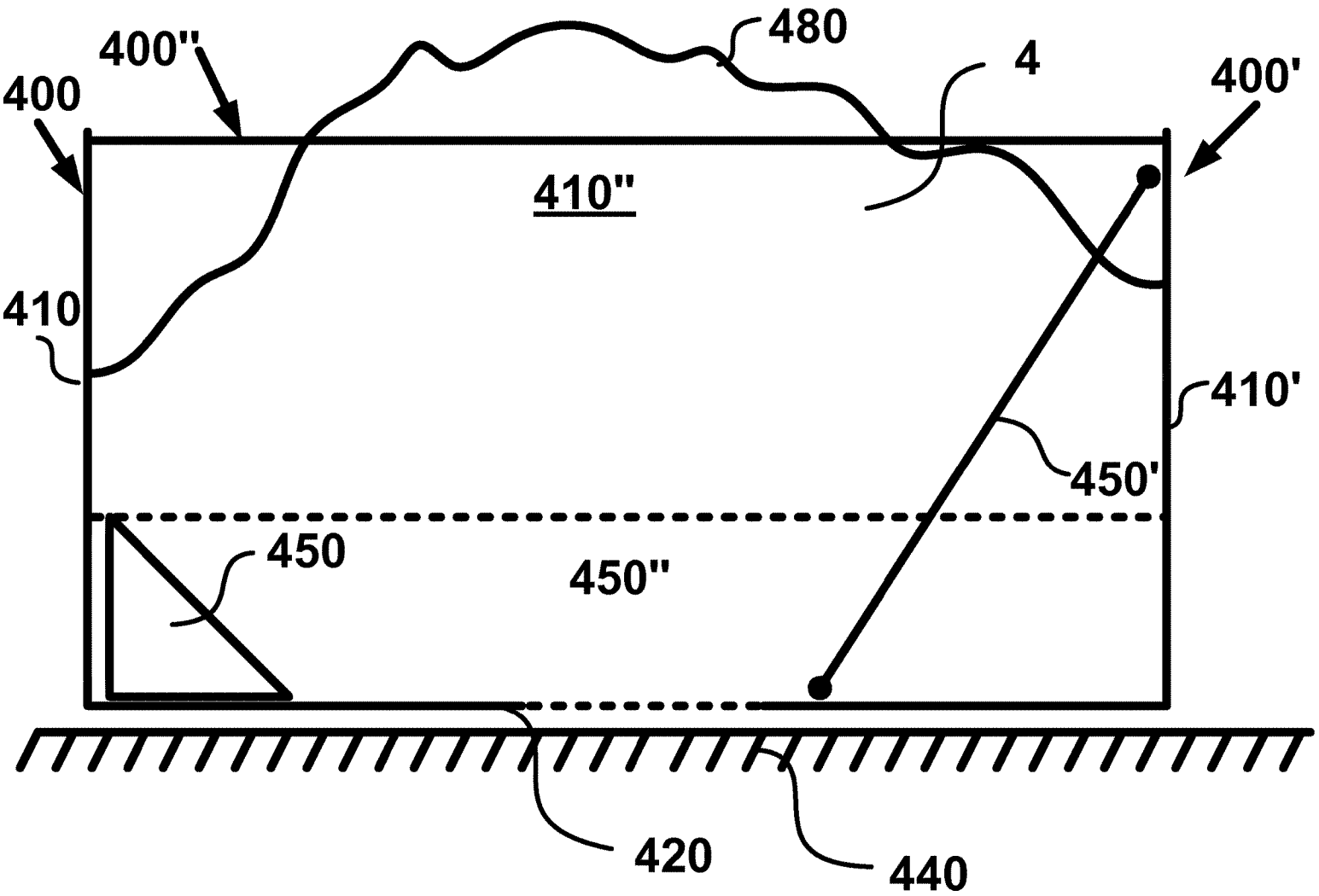
FIG. 4 illustrates a plurality of L-shaped barriers including a plurality of support members and substantially containing, impeding and/or blocking resting and/or moving bulk material in accordance with one aspect of embodiments.

Referring to example FIG. 4, a plurality of L-shaped barriers including a plurality of support members and substantially containing, impeding and/or blocking resting and/or moving bulk material is illustrated in accordance with one aspect of embodiments. According to embodiments, L-shaped barrier 400 may include vertical portion 410 and/or horizontal portion 420. In embodiments, vertical portion 410 may be in a raised position and horizontal portion 420 may be in a ground position. In embodiments, L-shaped barrier 400 may include one or more support members 450. In embodiments, like numerals may represent like elements, such that L-shaped barrier 400' may include a vertical portion 410', a horizontal portion 420', and a support member 450'.

According to embodiments, moveable material 480 may be provided to L-shaped barriers 400, 400' and/or 400". In embodiments, L-shaped barriers 400, 400' and/or 400" may be relatively easily distributed, and/or any area of containment may be formed. As illustrated in one aspect of embodiments, horizontal portions 420, 420' and 420" may not be in contact. In embodiments, the area of confinement may be larger than the combined size of shaped barriers 400, 400' and 400" by including a space between horizontal portions 420, 420' and 420". In another aspect of embodiments, bulk material 480 may be stacked up higher than vertical portions 400, 400' and/or 400" such that the area of confinement may be larger than the combined size of shaped barriers 400, 400' and 400".

According to embodiments, L-shaped barriers 400, 400' and/or 400" may leverage the weight of bulk material 480 to contain, impede and/or block bulk material 480. In embodiments, L-shaped barriers 400, 400' and/or 400" may be configured to increase the stabilizing force in an effective amount between L-shaped barriers 400, 400' and/or 400" and ground 440 to prevent substantial movement of L-shaped barriers 400, 400' and/or 400". In embodiments, barrier size, shape, assembly and/or composition may be configured to leverage the weight of bulk material 480 and/or to increase the stabilizing force between L-shaped barriers 400, 400' and/or 400" and ground 440.

As illustrated in one aspect of embodiments, L-shaped barriers 400, 400' and/or 400" may be configured to distribute a portion of the groundward force of bulk material 480 contacting L-shaped barriers 400, 400' and/or 400", for example on the receiving side of L-shaped barriers 400, 400' and/or 400". In embodiments, the groundward force of bulk material 480 may include a portion of the weight and/or mass of bulk material 480. In embodiments, the groundward force of bulk material 480 may include a portion of an approaching force of bulk material 480 relative to L-shaped barriers 400, 400' and/or 400". In embodiments, substantial movement of L-shaped barriers 400, 400' and/or 400" may be prevented in a horizontal plane relative to ground 440 and/or in a vertical plane relative to ground 440.

According to embodiments, a groundward force of bulk material 480 applied to horizontal portion 420, 420' and/or 420" may keep L-shaped barriers 400, 400' and/or 400" from substantially moving across ground 440. In embodiments, horizontal portion 420, 420' and/or 420" may distribute a groundward force of bulk material 480 in an effective amount to prevent substantial movement of L-shaped barriers 400, 400' and/or 400". In embodiments, a force of bulk material 480 may be countered by horizontal portion 420, 420' and/or 420", and/or may be countered by support members 450, 450' and/or 450". In embodiments, L-shaped barriers 410, 410' and/or 410" may keep bulk material 480 from substantially spreading to undesired and/or predetermined areas.

Figure 5A:
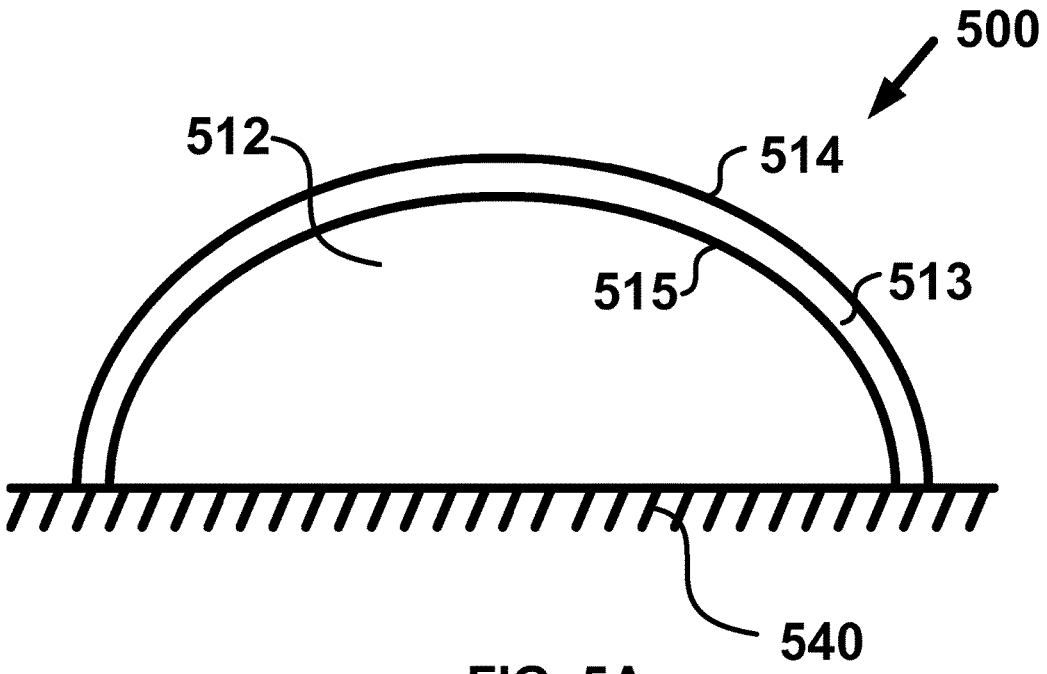
FIG. 5A illustrates a curved semicircular shaped barrier in accordance with one aspect of embodiments.
Figure 5B:
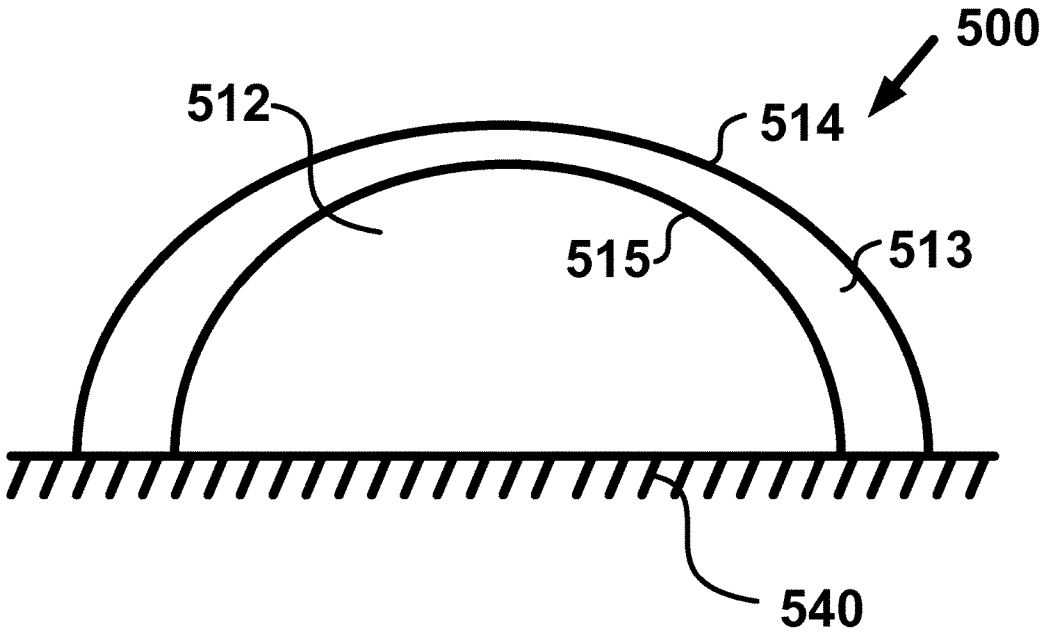
FIG. 5B illustrates a curved semicircular shaped barrier in accordance with one aspect of embodiments.

Referring to example FIG. 5A and FIG. 5B, a curved shaped barrier is illustrated in accordance with one aspect of embodiments. According to embodiments, curved shaped barrier 500 may be in the form of a shell structure. In embodiments, curved shaped barrier 500 may include a semispherical cross section, parabolic cross section, sinusoidal cross section, and the like. As illustrated in one aspect of embodiments, curved shaped barrier 500 may include a semicircular shape and/or may be formed having a double shell structure.

According to embodiments, a double shell structure may include barrier walls 514 and 515 spaced apart from each other, which together may form barrier space 513. In embodiments, semicircular shaped barrier 500 may include barrier cavity 512, which may be formed between barrier wall 514 and ground 540. In embodiments, barrier space 513 and/or barrier cavity 512 may be filled to form a non-solid and/or a solid volume. As illustrated in one aspect of embodiments, barrier space 513 and barrier cavity 512 may be filled with air to form non-solid volumes. According to embodiments, barrier space 513 may be hollow or solid. Additionally, embodiments may have barrier space 513 comprised of a different material than 514 and/or 515. Alternative embodiments may have barrier space comprised on a material that is the same as 514 and/or 515.

Figure 6:
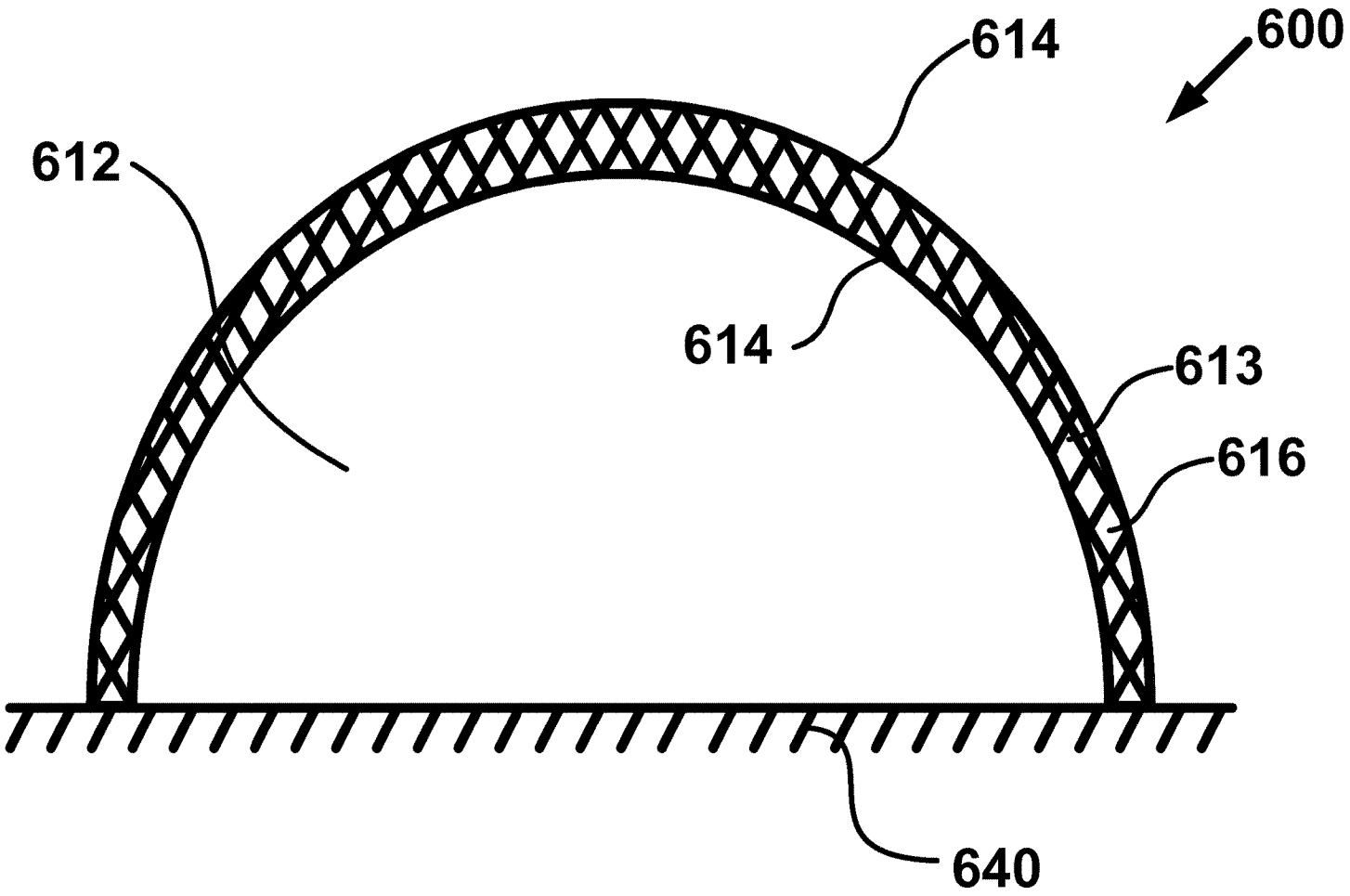
FIG. 6 illustrates a curved parabolic shaped barrier in accordance with one aspect of embodiments.

Referring to example FIG. 6, a curved shaped barrier is illustrated in accordance with one aspect of embodiments. According to embodiments, curved shaped barrier 600 may be in the form of a shell structure. In embodiments, curved shaped barrier 600 may include a semispherical cross section, parabolic cross section, sinusoidal cross section, and the like. As illustrated in one aspect of embodiments, curved shaped barrier 600 may include a parabolic shape and/or may be formed having a double shell structure.

According to embodiments, a double shell structure may include barrier walls 614 spaced apart from each other, which together may form barrier space 613. In embodiments, an inner barrier wall may relate to a wall facing ground 640. In embodiments, parabolic shaped barrier 600 may include barrier cavity 612, which may be formed between barrier wall 614 and ground 640. In embodiments, barrier space 613 and/or barrier cavity 612 may be filled to form a non-solid and/or a solid volume. As illustrated in one aspect of embodiments, barrier cavity 612 may be filled with air to form a non-solid volume. In embodiments, barrier volume 613 may be filled to include a combined non-solid volume and a solid volume. As illustrated in one aspect of embodiments, barrier space 613 may include braces 616 interposed with air, which together may provide a combined solid volume and non-solid volume.

Figure 7:
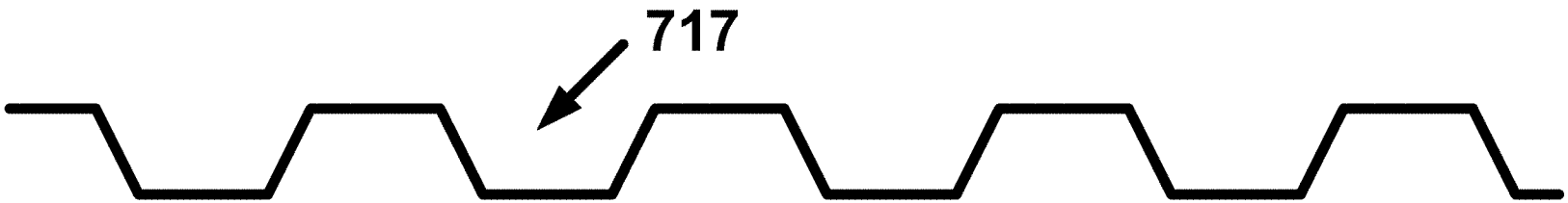
FIG. 7 illustrates a surface a shaped barrier in accordance with one aspect of embodiments.

Referring to example FIG. 7, a surface of a shaped barrier is illustrated in accordance with one aspect of embodiments. According to embodiments, a surface of a shaped barrier may include a surface of a barrier wall. In embodiments, a surface of a shaped barrier may not be uniform. As illustrated in one aspect of embodiments, a surface of a shaped barrier may include one or more trenches 717. In embodiments, trenches 717 may be tapered, spaced apart at any desired distance, and/or disposed in any desired direction.

Figure 8:
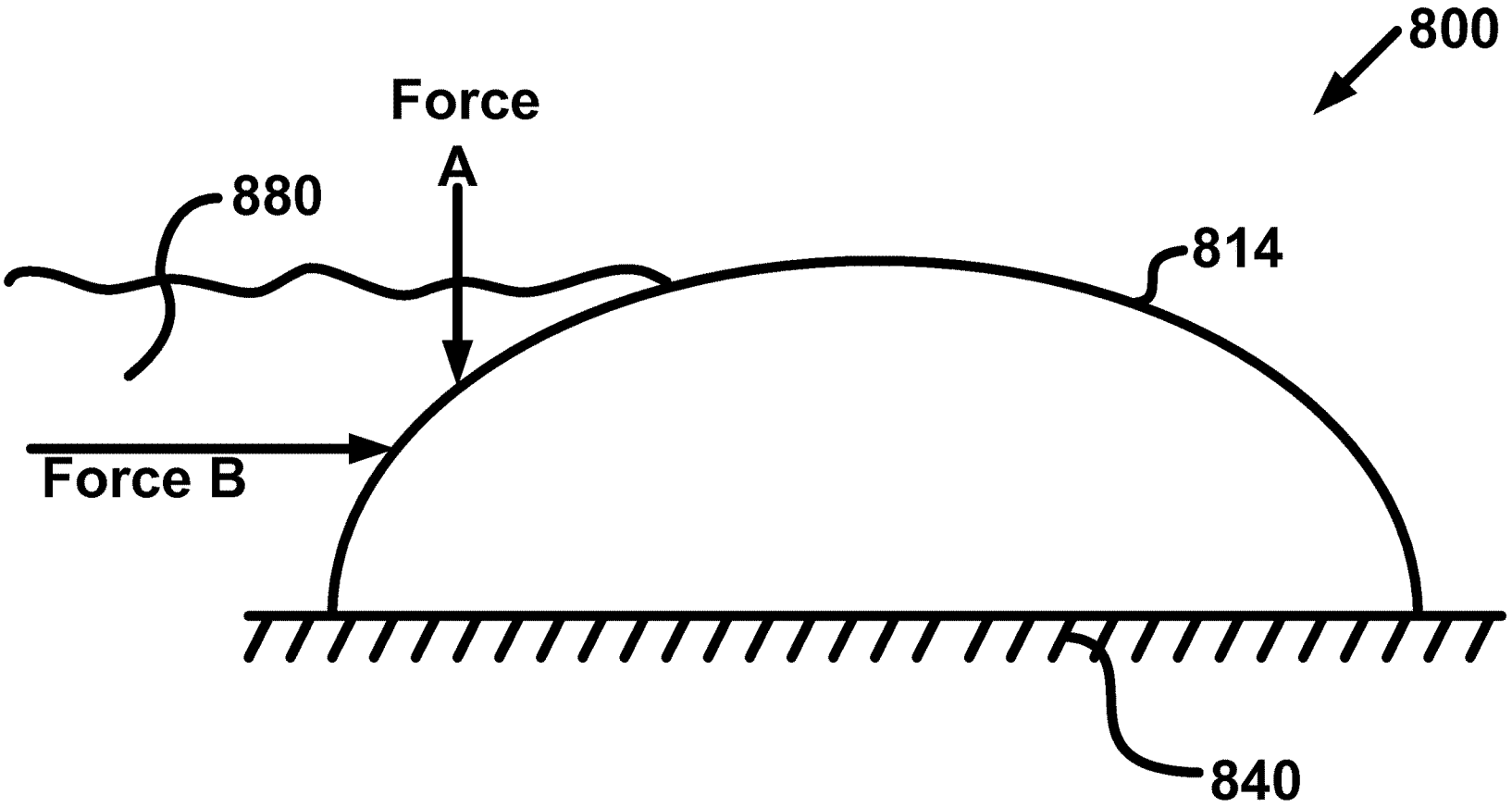
FIG. 8 illustrates a curved shaped barrier substantially containing, impeding and/or blocking resting and/or moving fluid material in accordance with one aspect of embodiments.

Referring to example FIG. 8, a curved shaped barrier substantially containing, impeding and/or blocking resting and/or moving fluid material in accordance with one aspect of embodiments. In embodiments, fluid material may include flood material. In embodiments, flood material may result from snow, water, surge waves and/or rain, and the like.

According to embodiments, curved shaped barrier 800 may leverage the weight of a fluid material 880 to contain, impede and/or block fluid material 880. In embodiments, curved shaped barrier 800 may be configured to increase the stabilizing force in an effective amount between curved shaped barrier 800 and ground 840 to prevent substantial movement of curved shaped barrier 800. In embodiments, barrier size, shape, assembly and/or composition may be configured to leverage the weight of fluid material 880 and/or to increase the stabilizing force between curved barrier 880 and ground 840.

As illustrated in one aspect of embodiments, curved shaped barrier 800 may be configured to distribute a portion of groundward force A of fluid material 880 contacting shaped barrier 800, for example on the receiving side of shaped barrier 800. In embodiments, groundward force A of fluid material 880 may include a portion of the weight and/or mass of fluid material 880. In embodiments, groundward force A of fluid material 880 may include a portion of an approaching force of fluid material 880 relative to curved shaped barrier 800. In embodiments, substantial movement of curved shaped barrier 800 may be prevented in a horizontal plane relative to ground 840 and/or in a vertical plane relative to ground 840.

According to embodiments, force A of fluid material 880 applied to barrier wall 814 may keep cured shaped barrier 800 from substantially moving across ground 840. In embodiments, barrier wall 814 may distribute force A of fluid flood material 880 in an effective amount to prevent substantial movement of curved shaped barrier 800. In embodiments, shaped barrier 800 may keep fluid material 880 from substantially spreading to undesired and/or predetermined areas.

Figure 9:
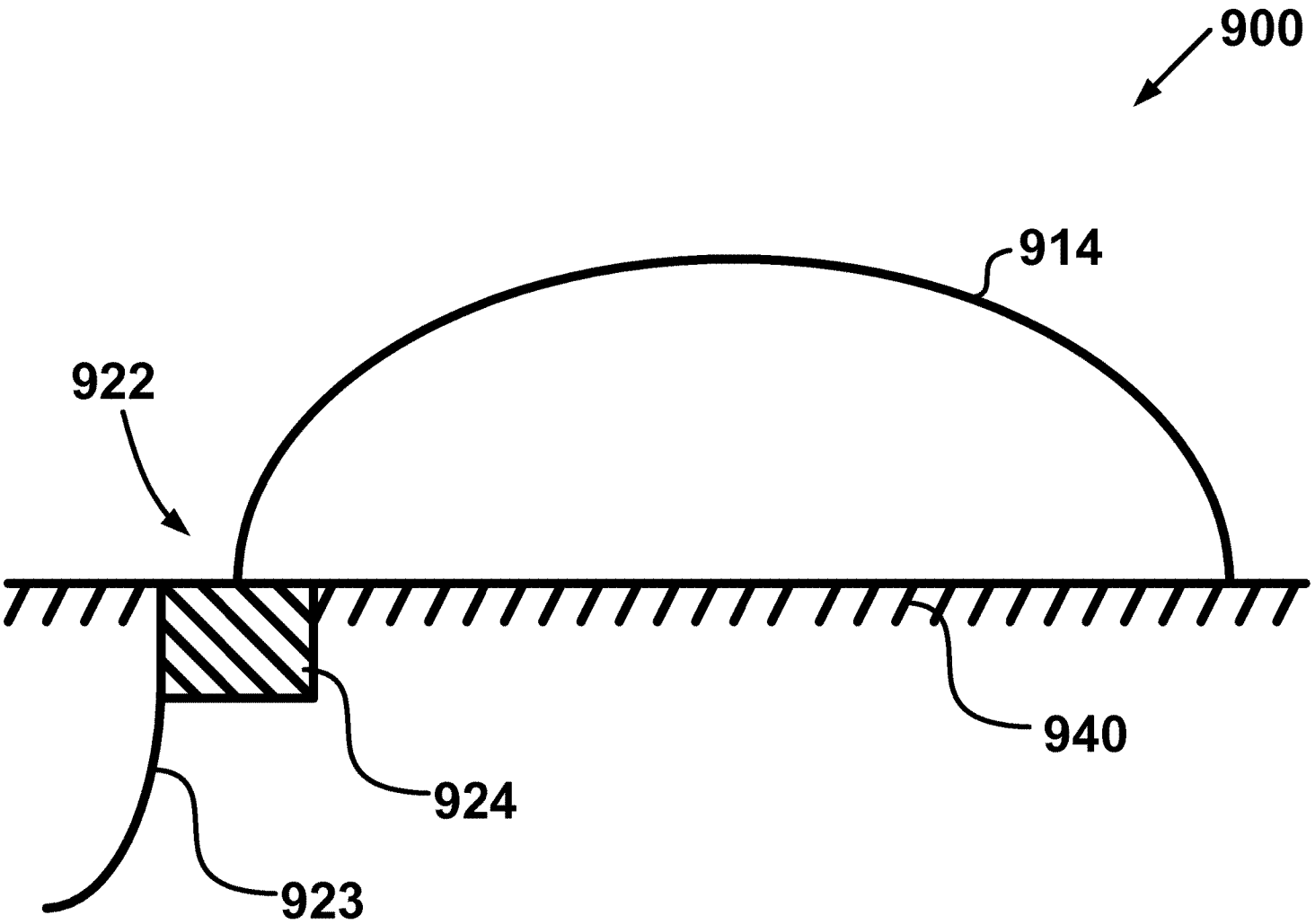
FIG. 9 illustrates a curved shaped barrier including a stabilization enhancer in accordance with one aspect of embodiments.
Figure 10:
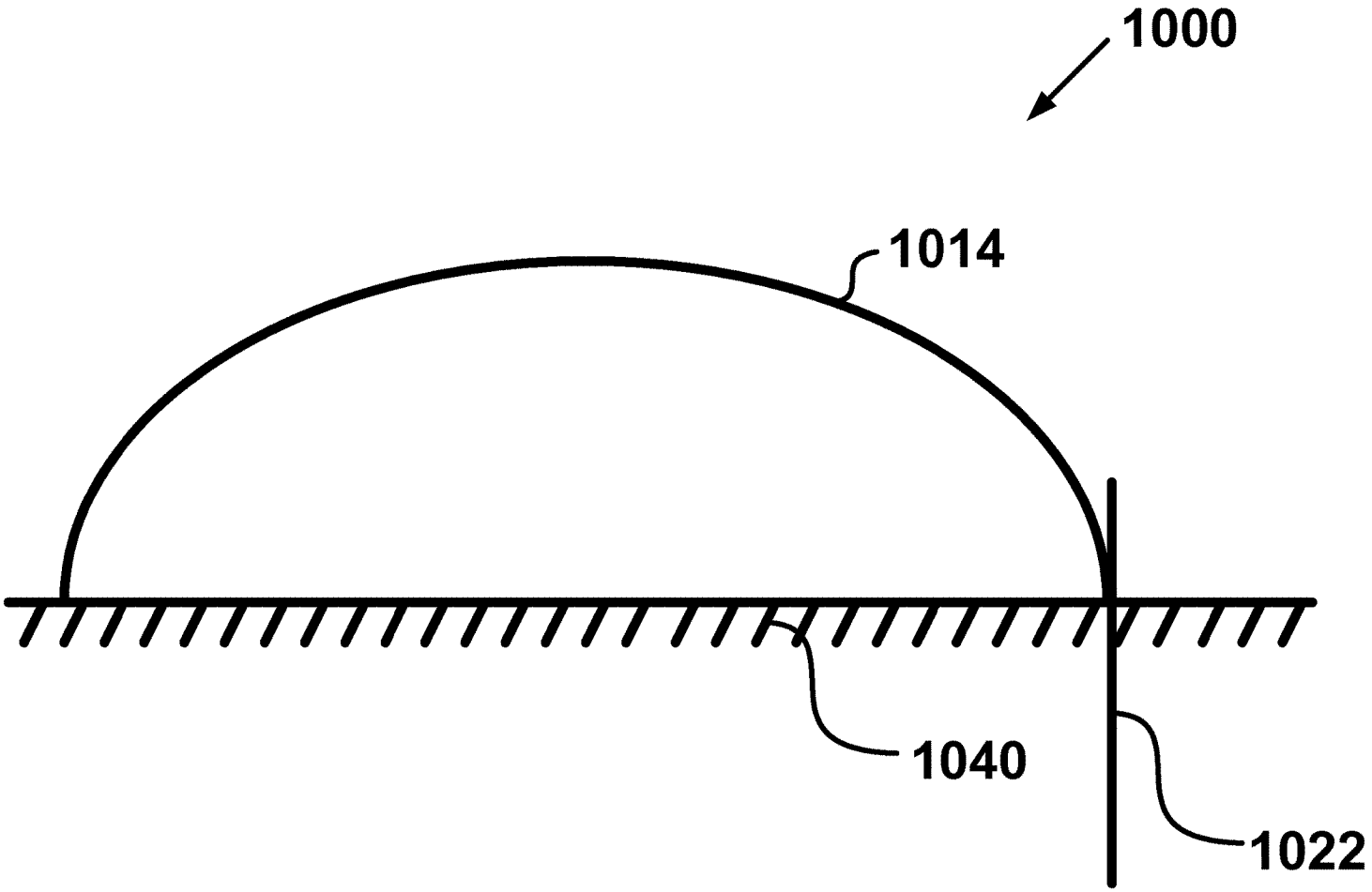
FIG. 10 illustrates a curved shaped barrier including a stabilization enhancer in accordance with one aspect of embodiments.
Figure 11:
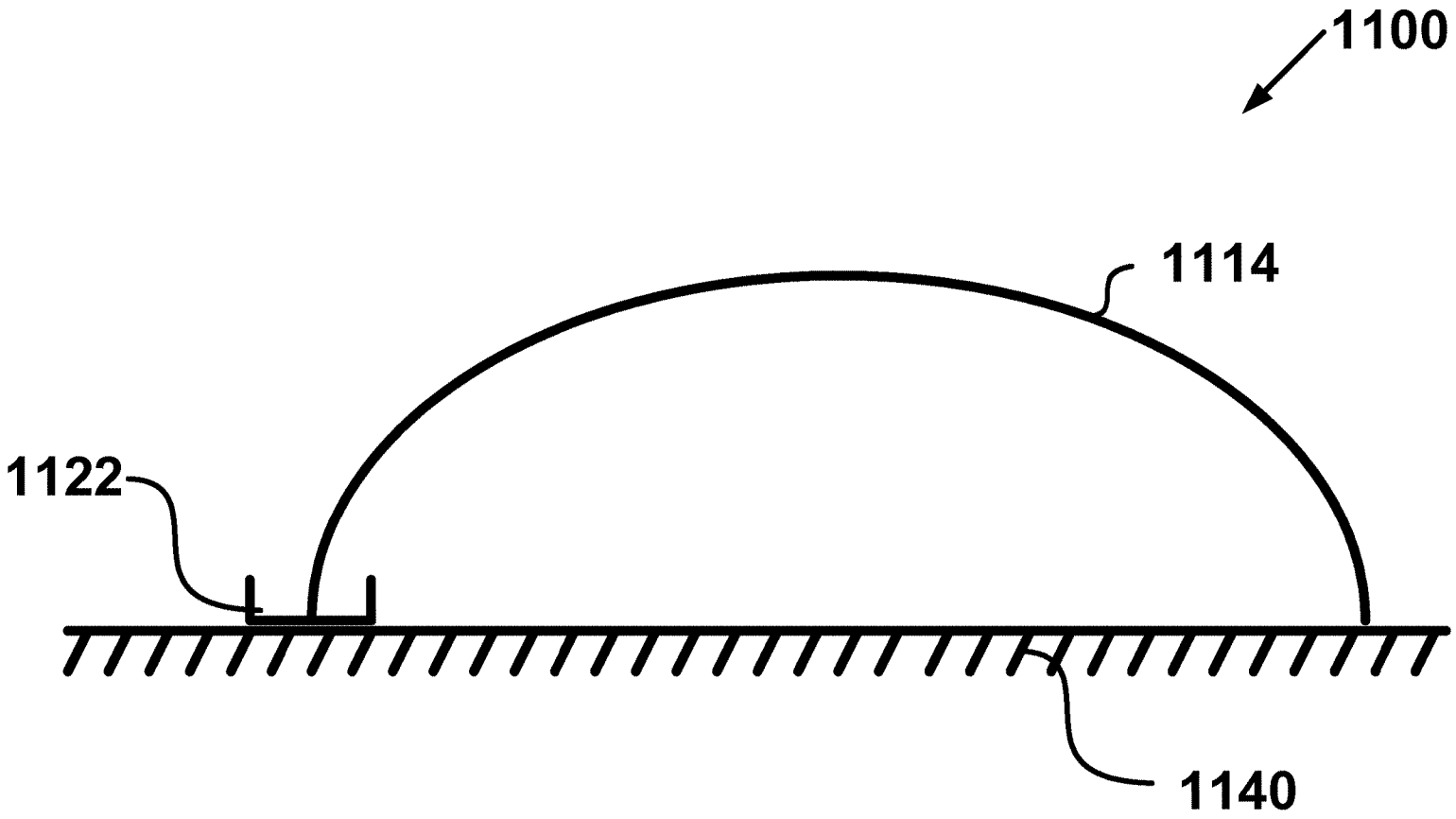
FIG. 11 illustrates a curved shaped barrier including a stabilization enhancer in accordance with one aspect of embodiments.

Referring to example FIG. 9 to FIG. 11, a curved shaped barrier including a stabilization enhancer is illustrated in accordance with one aspect of embodiments. According to embodiments, a stabilization enhancer may stabilize a shaped barrier and/or shaped barrier portion from substantial movement, for example minimize sinking, sliding, and/or overturning. As illustrated in one aspect of embodiments in FIG. 9, stabilization enhancer 922 may include a block 924 and/or a sheet 923.

In embodiment 900, stabilization enhancer 922 may contact and/or connect with curved shaped barrier 914. In embodiments, stabilization enhancer 922 may be hidden from the environment, for example disposed in ground 940. In embodiments, stabilization enhancer 922 may be disposed on a safe-zone side of curved shaped barrier 914 and/or on a receiving side of curved shaped barrier 914.

As illustrated in one aspect of embodiment 1000 in FIG. 10, stabilization enhancer 1022 may include a rod. According to embodiments, stabilization enhancer 1022 may contact and/or connect with curved shaped barrier 1014. In embodiments, stabilization enhancer 1022 may be exposed to the environment, for example partially disposed in ground 1040. In embodiments, stabilization enhancer 1022 may be disposed on a safe-zone side of curved shaped barrier 1014 and/or on a receiving side of curved shaped barrier 1014.

As illustrated in one aspect of embodiments in FIG. 11, stabilization enhancer 1122 may include a shaped foot. According to embodiments, stabilization enhancer 1122 may contact and/or connect with curved shaped barrier 1100. In embodiments, stabilization enhancer 1122 may be partially exposed to the environment, for positioned at the interface between barrier wall 1114 and ground 1140. In embodiments, stabilization enhancer 1122 may be disposed on a safe-zone side of curved shaped barrier 1100 and/or on a receiving side of curved shaped barrier 1100.

Figure 12:
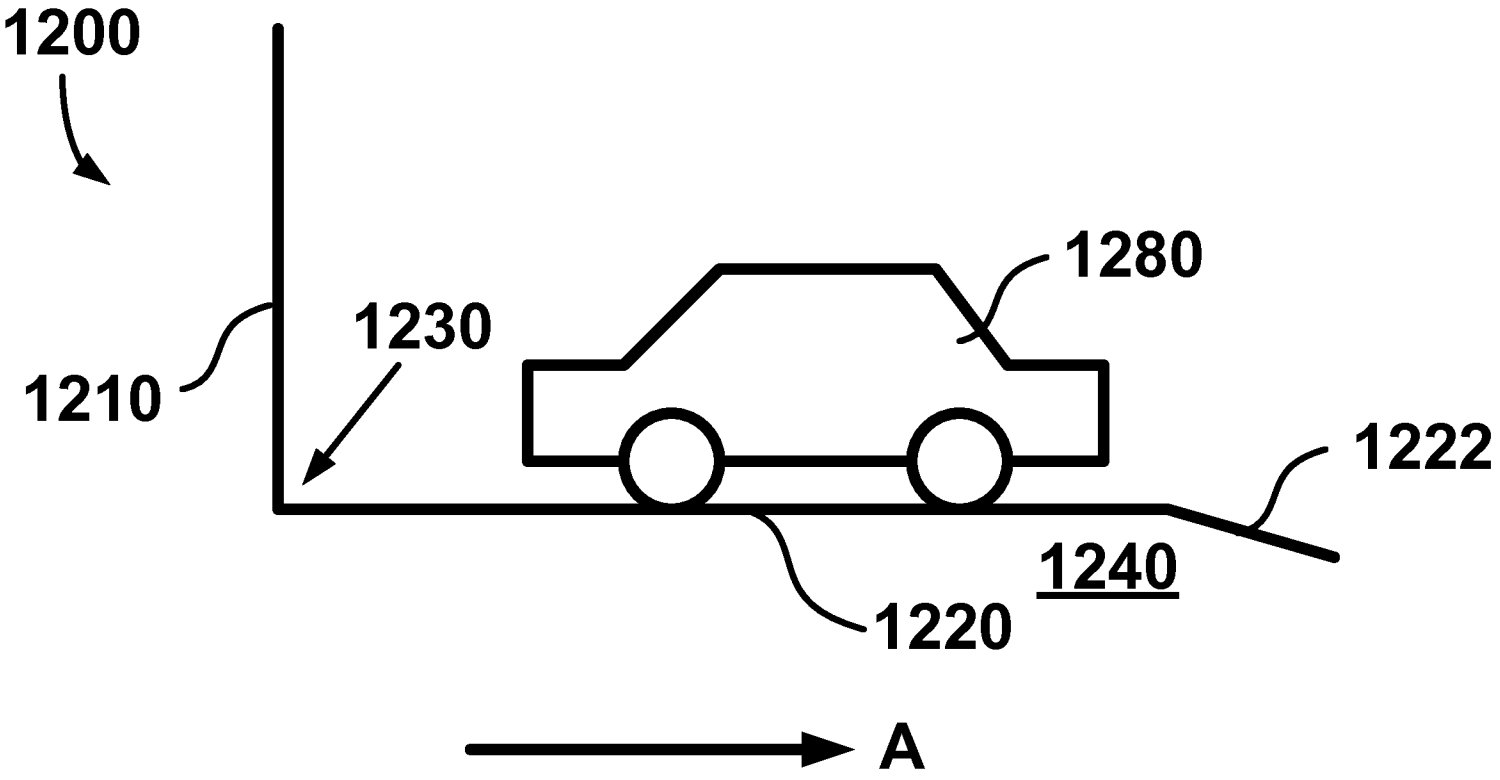
FIG. 12 illustrates an L-shaped barrier including a stabilization enhancer substantially containing, impeding and/or blocking a vehicle in accordance with one aspect of embodiments.

Referring to example FIG. 12, an L-shaped barrier including a stabilization enhancer substantially containing, impeding and/or blocking a vehicle is illustrated in accordance with one aspect of embodiments. According to embodiments, L-shaped barrier 1200 may include vertical portion 1210 and/or horizontal portion 1220. In embodiments, vertical portion 1210 may be connected with horizontal portion 1220 at connection area 1230. In embodiments, vertical portion 1210 may be in a raised position and horizontal portion 1220 may be in a ground position. As illustrated in one aspect of embodiments, horizontal portion 1220 may include stabilization enhancer 1222, for example a ramp. In embodiments, stabilization enhancer may include a smooth surface. In embodiments, stabilization enhancer 1222 may be partially disposed in ground 1240.

According to embodiments, L-shaped barrier 1200 may leverage the energy of vehicle 1280 to contain, impede and/or block vehicle 1280. In embodiments, L-shaped barrier 1200 may be configured to increase the stabilizing force in an effective amount between L-shaped barrier 1200 and ground 1240 to prevent substantial movement of L-shaped barrier 1200. In embodiments, barrier size, shape, assembly and/or composition may be configured to leverage the energy of vehicle 1280 and/or to increase the stabilizing force between L-shaped barrier 1200 and ground 1240.

As illustrated in one aspect of embodiments, L-shaped barrier 1200 may be configured to distribute a portion of a groundward force of vehicle 1245 contacting L-shaped shaped barrier 1200, for example on the receiving side of shaped barrier 1200. In embodiments, a groundward force of vehicle 1245 may include a portion of the weight and/or mass of vehicle 1245. In embodiments, a groundward force of vehicle 1245 may include a portion of an approaching force of vehicle 1245 relative to L-shaped barrier 1200.

According to embodiments, a groundward force of vehicle 1280 applied to horizontal portion 1220 may keep barrier 1200 from substantially moving across ground 1240. In embodiments, horizontal portion 1220 may distribute a groundward force of vehicle 1245 in an effective amount to prevent substantial movement of L-shaped barrier 1200. In embodiments, relatively large friction force A between horizontal portion 1220 and ground 1240 may minimize movement of L-shaped barrier 1200. In embodiments, L-shaped barrier 1200 may keep vehicle 1280 from substantially spreading to undesired and/or predetermined areas.

Figure 13:
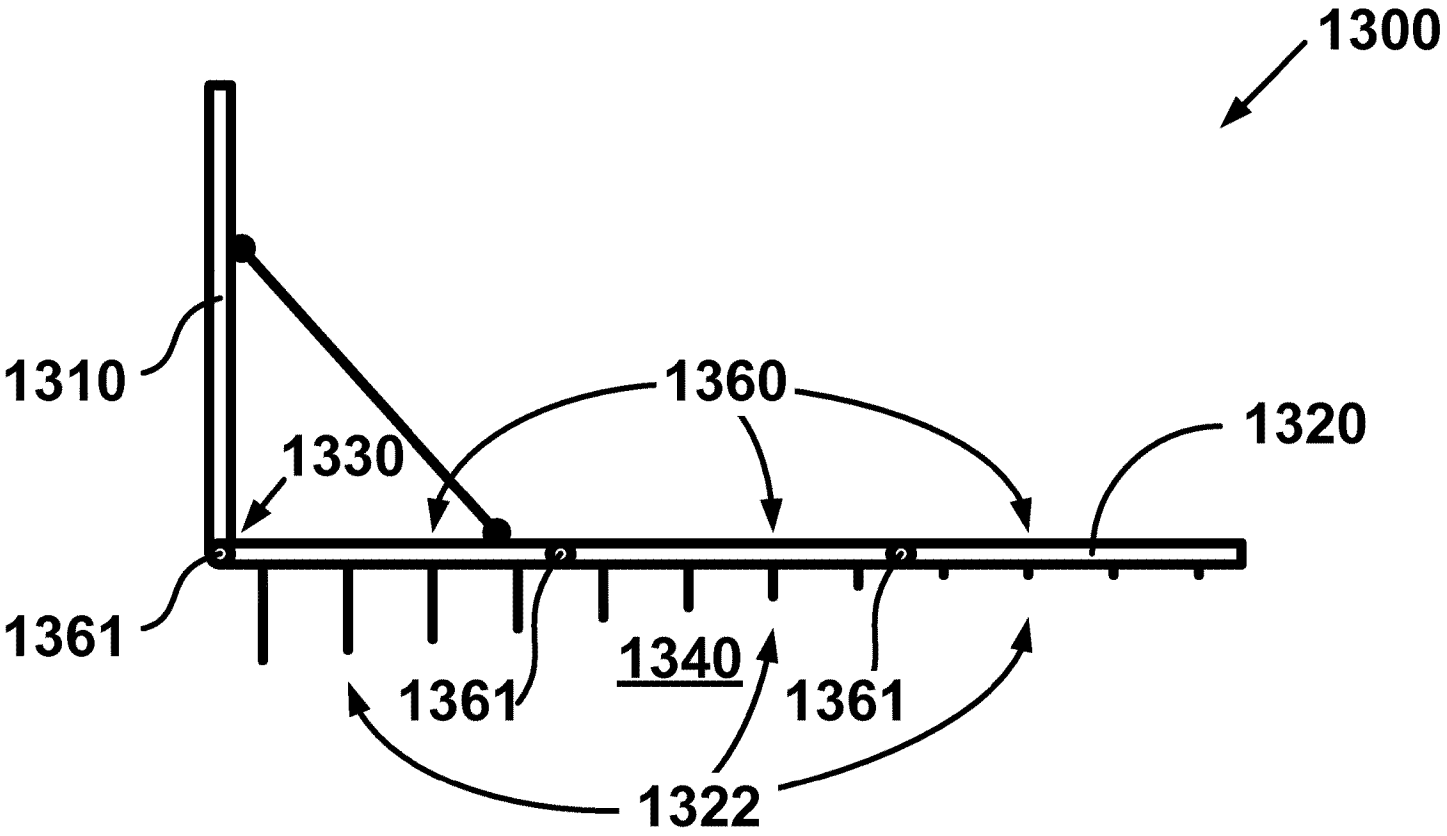
FIG. 13 illustrates an L-shaped barrier including a collapsible section and a stabilization enhancer in accordance with one aspect of embodiments.

Referring to example FIG. 13, an L-shaped barrier including a collapsible section and a stabilization enhancer is illustrated in accordance with one aspect of embodiments. According to embodiments, L-shaped barrier 1300 may include vertical portion 1310 and/or horizontal portion 1320. In embodiments, vertical portion 1310 may be connected with horizontal portion 1320 at connection area 1330 using hinge connection 1361 and a support member. In embodiments, vertical portion 1310 may be in a raised position and horizontal portion 1320 may be in a ground position.

As illustrated in one aspect of embodiments, horizontal portion 1320 may include a plurality of connected sections 1360. In embodiments, one or more connected sections 1360 may be connected using hinge connection 1361, which may maximize the ability of barrier 1300 to collapse and unfold for movement, storage, deployment, and the like. In embodiments, horizontal portion 1320 may include a plurality of stabilization members 1322. In embodiments, stabilization member 1322 may include a spike. As illustrated in one aspect of embodiments, stabilization member 1322 may include spikes having the same and/or different dimensions, for example increasing length moving in a direction towards vertical portion 1310.

According to embodiments, stabilization member 1322 may maximize resistance of L-shaped barrier 1300 with respect to ground 1340. In embodiments, the movement of L-shaped barrier 1300 may be minimized. In embodiments, a contact body and/or moveable material may initially contact horizontal portion 1320, such that relatively short stabilization members 1322 may minimize an approaching and/or impact force between barrier 1300 and the contact body, and/or may maximize friction force between barrier 1300 and ground 1340. In embodiments, a contact body traveling along horizontal portion 1320 may enable relatively larger stabilization enhancers to further maximize friction between barrier 1300 and ground 1340.

Figure 14:
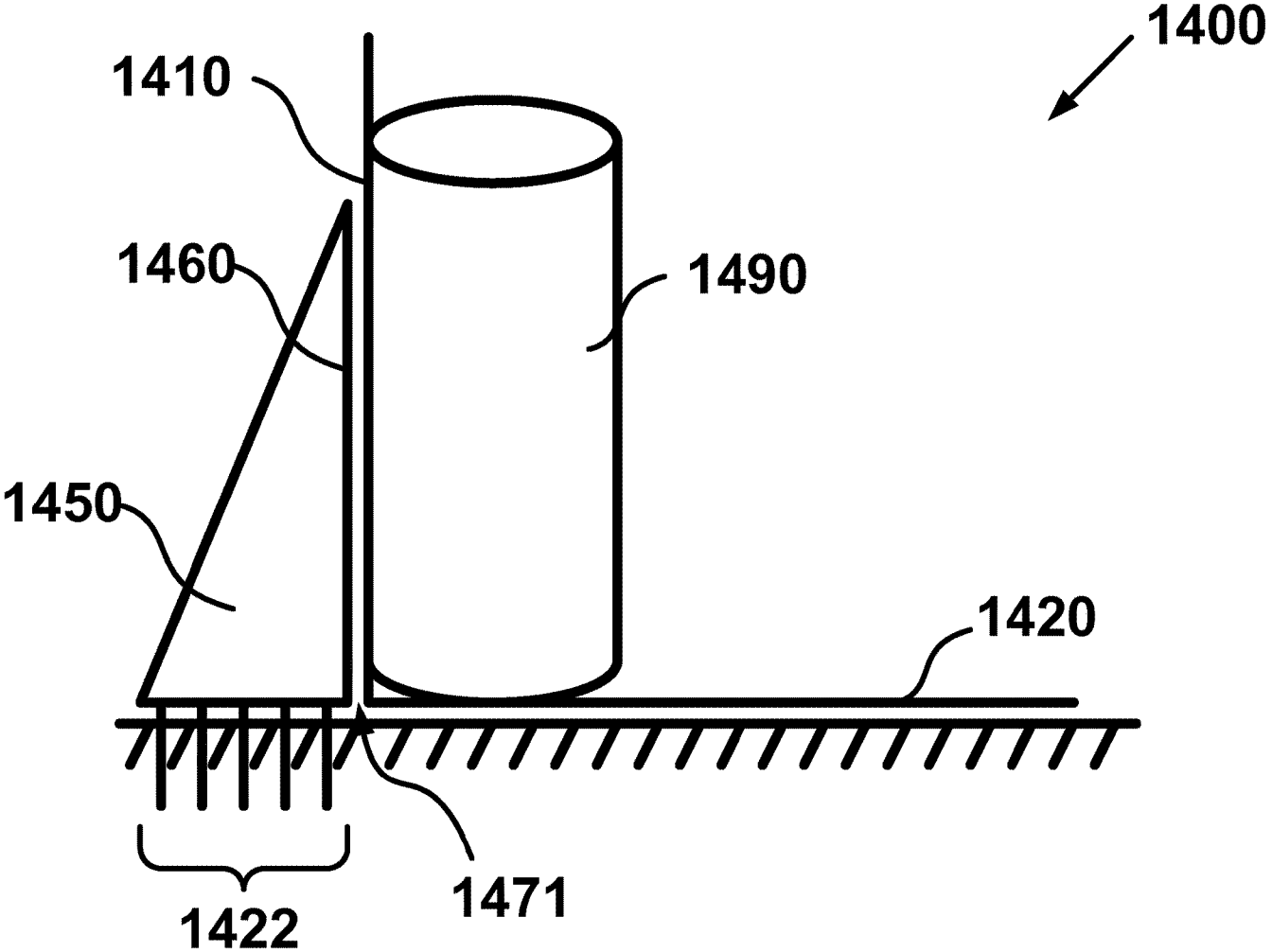
FIG. 14 illustrates an L-shaped barrier including a stabilization enhancer, a support member and an energy absorber in accordance with one aspect of embodiments.

Referring to example FIG. 14, an L-shaped barrier including a stabilization enhancer, a support member and an energy absorber is illustrated in accordance with one aspect of embodiments. According to embodiments, L-shaped barrier 1400 may include vertical portion 1410 and/or horizontal portion 1420. In embodiments, vertical portion 1410 may be connected with horizontal portion. In embodiments, vertical portion 1410 may be in a raised position and horizontal portion 1420 may be in a ground position.

As illustrated in one aspect of embodiments, L-shaped barrier 1400 may include one or more support members 1450. In embodiments, support member 1450 may be a triangle block exposed to the environment and positioned to contact vertical portion 1410 at a safe zone of L-shaped barrier 1400. In embodiments, support member 1450 may be connected to barrier 1400 at one or more points along side 1460 using a connector. In embodiments, barrier 1400 may include a stabilization enhancer 1422 connected to support member 1450.

As illustrated in one aspect of embodiments, L-shaped barrier 1400 may include energy absorber 1490. In embodiments, energy absorber 1490 may absorb a portion of the energy of a moveable material and/or contact body. In embodiments, energy absorber 1490 may contact and/or be connected with shaped barrier 1400. In embodiments, energy absorber 1490 may be exposed to the environment. In one aspect of embodiments, energy absorber 1490 may be disposed between shaped barrier 1400 and a contact body on the receiving side of shaped barrier 1400. In embodiments, the energy absorber 1490 may absorb at least a portion of a horizontal and/or groundward force.

While various embodiments have been described above, it should be understood that they have been presented by way of example, and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments. Thus, the present embodiments should not be limited by any of the above described exemplary embodiments. In particular, it should be noted that, for example purposes, the above explanation has focused containing, impeding and/or blocking bulk material, fluid material and/or vehicles. However, one skilled in the art will recognize that embodiments could be applied to any moveable material for any reason, for example to separate animal populations, for crowd control, for sporting events, and the like.

Embodiments may also recognize other sizes, shapes, assemblies and/or compositions suitable to increase the stabilizing force between the barrier and the ground to prevent substantial movement of the barrier. The properties of a shaped barrier may be tailored by configuring the size, shape, assembly and/or composition of a shaped barrier and/or shaped barrier portion, alone or in combination, using any manual and/or automated process, for example as illustrated in example Table 1.

EXAMPLE TABLE 1

| Parts | Attributes | Sub-solutions | | | | |
|---|---|---|---|---|---|---|
| Vertical Portion | Shape | Drum | Rail | Flat plate | | |
| | Material | Steel | Plastic | Timber | Rubber | |
| | Filling | None | Water | Sand | | |
| | Front Face Coverage | None | Rubber | Plastic | | |
| Connection | | None | Hinged | Bolted | Glued | Welded |
| Horizontal Portion | Shape | Flat plate | Mattress | | | |
| | Material | Steel | Plastic | Rubber | Timber | Combination |
| | Filling | None | Water | Sand | | |
| | Bottom Face | Smooth | Rough | Spikes | Groves | |
| Bracing | | None | Steel ties | Steel trusses | | |

Therefore, an automated process may provide a vertical portion configured to include a steel plate having a flat plate shape and connected to a horizontal portion by a hinge connection as illustrated in example Table 1. However, any geometry, property, connection and/or material may be included in embodiment processes. For example, Table 1 may include a curved portion, an energy absorber, length of portions, weight of the barrier, environment, and the like. As another example, any shape may be included, such as a trapezoid shape, rectangular shape, a stepped shape, and the like.

Embodiments may also recognize further modifications. For example, a vertical shape may relate to a substantially vertical shape, a curved shape may relate to a substantially curved shape, a non-solid volume may relate to a substantially non-solid volume, a smooth surface may relate to a substantially smooth surface, and the like. As another example, a vertical portion and/or a horizontal portion may include barrier spaces. As another example, a support member may include a block cavity and/or a block space. As a final example, a connection area may be formed at any point along a vertical portion, a horizontal portion, a curved portion, and the like.

Embodiments may also recognize other deployment configurations. For example, rotation of L-shaped barrier 100 and/or L-shaped barrier 200 by 180 degrees relative to the ground may provide a triangular shaped barrier having a barrier cavity, which may include a non-solid volume and/or a solid volume. As another example, two parabolic shaped barriers may be interconnected on a safe zone side by a horizontal shaped barrier portion, for example to provide a redundant barrier. As a final example, an L-shaped barrier may be interconnected with a curved shaped barrier.

Embodiments may also recognize other deployment configurations. For example, rotation of L-shaped barrier 100 and/or L-shaped barrier 200 by 180 degrees relative to the ground may provide a triangular shaped barrier having a barrier cavity, which may include a non-solid volume and/or a solid volume. As another example, two parabolic shaped barriers may be interconnected on a safe zone side by a horizontal shaped barrier portion, for example to provide a redundant barrier. As a final example, an L-shaped barrier may be interconnected with a curved shaped barrier.

In some cases, it may be desired to fix a barrier in place. As described earlier, barriers may be staked to the ground. Another method of fixing the position of a barrier may be to place it up against a curb. So, for example, if a neighborhood is in threat of flooding, a series of barriers may be deployed in the street up against the edge of a curb to keep them in place.

Another method for fixing a barrier in place may be to weigh it down. Example FIG. 16A illustrates a side view of a weighted shell shaped barrier in accordance with one aspect of embodiments. As illustrated, a shell shaped barrier 1610 may be set on the ground with a weight 1620, such as a sandbag, placed on top. To accommodate the weight 1620, a concave surface can be embedded on the top of the shell shaped barrier 1610. Example FIG. 16B illustrates a front view of a series of joined and weighted shell shaped barriers in accordance with one aspect of embodiments. As illustrated, joined barriers 1610*a*, 1610*b* and 1610*c* are weighted down by weights 1620*a*, 1620*b* and 1620*c* respectively.

In addition, it should be understood that any figures which highlight the functionality and advantages, are presented for example purposes only. The disclosed architecture is sufficiently flexible and configurable, such that it may be utilized in ways other than that shown. For example, a circular barrier may be utilized to impede the movement of a vehicle and/or contain bulk material, and/or an L-shaped barrier may be utilized to block the flow of a flood material.

Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

Finally, it is the applicant's intent that only claims that include the express language "means for" or "step for" be interpreted under 35 U.S.C. 112, paragraph 6. Claims that do not expressly include the phrase "means for" or "step for" are not to be interpreted under 35 U.S.C. 112, paragraph 6.

What is claimed is:

1. A shaped barrier comprising:

a. a substantially horizontal portion;

b. a ramp portion positioned to receive a rolling vehicle onto the horizontal portion receiving side of the shaped barrier, the ramp portion being a substantially rigid portion;

c. a stabilization enhancer positioned to enhance the stabilizing force between the shaped barrier and the ground in an effective amount to prevent substantial movement of the shaped barrier by distributing at least a portion of a groundward force of the rolling vehicle on the receiving side of the shaped barrier;

d. a substantially vertical portion positioned to impede the movement of the rolling vehicle from the receiving side of the shaped barrier to a safe zone side of the shaped barrier; and e. at least one connector portion positioned to connect the shaped barrier with at least one other shaped barrier.

2. The shaped barrier according to claim 1, wherein the shaped barrier comprises an L shape.

3. The shaped barrier according to claim 1, wherein the shaped barrier includes a curved shape.

4. The shaped barrier according to claim 1, wherein the substantially vertical portion and the substantially horizontal portion are connected to each other using at least one of the following:

a. a hinge;

b. a weld;

c. a bolt;

d. an adhesive;

e. magnet, f. lock-and-key;

g. rail; or h. a combination of the above.

5. The shaped barrier according to claim 1, wherein at least a portion of the shaped barrier includes a plurality of collapsible sections.

6. The shaped barrier according to claim 1, further including a support member.

7. The shaped barrier according to claim 6, wherein the support member includes at least one of the following:

a. a block;

b. a tie;

c. a sheet;

d. a rod; or e. a combination of the above.

8. The shaped barrier according to claim 1, wherein the shaped barrier is connected to the at least one other shaped barrier using at least one of the following:

a. a seal;

b. a flexible covering;

c. a hard covering; or d. a combination of the above.

9. The shaped barrier according to claim 1, wherein the shaped barrier comprises one or more support members positioned to contact the substantially vertical portion.

10. The shaped barrier according to claim 1, wherein the shaped barrier includes a non-solid volume located in at least one of the following:

a. a cavity formed by the shaped barrier; and b. between an outer wall and an inner wall of the shaped barrier.

11. The shaped barrier according to claim 1, wherein the stabilization enhancer comprises a multitude of distributed ground penetrating members of various lengths.

12. The shell shaped barrier according to claim 1, wherein the stabilization enhancer includes at least one of the following:

a. a spike;

b. a block;

c. a sheet;

d. a rod;

e. a ramp;

f. a street curb;

g. a sand bag; or h. a combination of the above.

13. The shaped barrier according to claim 1, wherein the stabilization enhancer is part of at least one of the receiving side and the safe zone side.

14. The shaped barrier according to claim 1, wherein the substantially horizontal portion is further configured to support the rolling vehicle.

15. The shaped barrier according to claim 1, wherein the groundward force includes at least one of the following:

a. at least a portion of the weight of the rolling vehicle; and b. at least a portion of the approaching force of the rolling vehicle.

16. The shaped barrier according to claim 1, further comprising an energy absorber configured to absorb at least a portion of the horizontal force of the rolling vehicle.

17. The shaped barrier according to claim 1, wherein at the surface of the shaped barrier includes:

a. a substantially deformable portion; and b. a substantially rigid portion.

18. The shaped barrier according to claim 1, wherein the substantially horizontal portion comprises at least two sections connected to each other using at least one hinge.

19. The shaped barrier according to claim 1, wherein the shaped barrier comprises a reversed T shape.

* * * * *